United States Patent [19]

Driggers

[11] 4,300,502

[45] Nov. 17, 1981

[54] FUEL FLOW CONTROL SYSTEM FOR INTERNAL COMBUSTION ENGINES

[75] Inventor: Vernon J. Driggers, Scranton, S.C.

[73] Assignee: Driggers & Associates, Inc., Scranton, S.C.

[21] Appl. No.: 117,971

[22] Filed: Feb. 4, 1980

Related U.S. Application Data

[63] Continuation-in-part of Ser. No. 899,405, Apr. 24, 1978, Pat. No. 4,186,707.

[51] Int. Cl.[3] ..... F02M 37/04

[52] U.S. Cl. ..... 123/389; 123/463; 123/512; 251/309

[58] Field of Search ..... 123/319, 378, 389, 457, 123/460, 463, 511–513; 251/61, 309; 261/69, 34 A

[56] References Cited

U.S. PATENT DOCUMENTS

| | | | |
|---|---|---|---|
| 2,884,918 | 5/1959 | Klug | 123/512 |
| 3,521,856 | 7/1970 | Smith | 251/309 |
| 3,674,238 | 7/1972 | Pickles et al. | 251/309 |
| 4,178,882 | 12/1979 | Anderson et al. | 123/3 |
| 4,186,707 | 5/1980 | Driggers | 123/512 |
| 4,237,849 | 12/1980 | Roberts | 123/512 |

FOREIGN PATENT DOCUMENTS

| | | | |
|---|---|---|---|
| 2507307 | 9/1975 | Fed. Rep. of Germany | 123/511 |

*Primary Examiner*—Craig R. Feinberg
*Attorney, Agent, or Firm*—Luke J. Wilburn, Jr.; Wellington M. Manning, Jr.; John B. Hardaway, III

[57] ABSTRACT

A fuel economizer system and fuel flow control valve arrangement for an internal combustion engine having a fuel supply tank, a main fuel supply line connecting the tank to the carburetor inlet of the engine, and a fuel pump in the supply line for delivering fuel to the carburetor inlet. The control valve arrangement is located in the fuel supply line between the fuel pump and the carburetor inlet, and includes a first control valve which is automatically incrementally adjusted between closed and open position by a diaphragm motor which is operatively connected to the intake manifold of the engine such that changes in vacuum in the intake manifold automatically adjust the control valve to proportionally increase or decrease the supply of fuel to the carburetor inlet. Connected in parallel with the first control valve in the fuel line to the carburetor is a fuel pressure regulator valve which ensures a predetermined minimum fuel pressure and flow to the carburetor inlet when fuel flow through the first control valve is insufficient to maintain such fuel pressure at the carburetor inlet.

8 Claims, 6 Drawing Figures

FUEL FLOW CONTROL SYSTEM FOR INTERNAL COMBUSTION ENGINES

This application is a continuation-in-part of my copending patent application Ser. No. 899,405, filed Apr. 24, 1978, which is now U.S. Pat. 4,186,707 issued on Feb. 5, 1980.

The present invention relates to a modified fuel flow control valve arrangement and fuel supply system for internal combustion engines from that described in my said copending application.

BACKGROUND OF THE INVENTION

Due to decreasing availability and increasing expense of petroleum fuels, as well as the increasing public awareness of the environmental pollution due to by-products of combustion of such fuels, there is a continuous effort to improve the efficiency of fuel consumption in internal combustion engines. In particular, the automotive industry, with the assistance of federal requirements, is ever seeking ways to increase gas consumption efficiency and minimize environmental contamination from the by-products of fuel combustion in the automobile engine.

In a conventional automobile fuel system, fuel is supplied from the fuel tank to the carburetor of the engine by means of a fuel pump located in the fuel line. The pump is designed to provide fuel at all times under constant pressure to the carburetor fuel bowl, and the amount of fuel in the bowl is controlled by an inlet needle valve and float system. As fuel is supplied in metered amounts from the bowl to the venturi section of the carburetor for mixture with air before passing into the engine intake manifold, the bowl is refilled with fuel under a constant pressure from the fuel pump. Since periods of acceleration and heavier load on the engine require a faster supply of fuel to the engine, the constant pressure of the fuel pump must be necessarily high enough to satisfy these peak fuel supply requirements. Due to the high fuel pump pressures required for heavy load conditions, I have discovered that the fuel pump delivers more fuel to the carburetor at idle and no-load conditions than is required by the engine. This excess supply of fuel to the carburetor decreases the fuel consumption efficiency of the engine and produces greater non-combusted by-products of fuel combustion in the engine exhaust.

The invention of my said copending application is directed to a fuel economizer system for internal combustion engines having an automatically adjustable fuel flow control valve located in the main fuel supply line between the fuel pump and the inlet to the carburetor to provide a lower fuel pressure and correspondingly less fuel to the carburetor and engine of the automobile during idle and normal load driving conditions while automatically providing higher fuel pressures and more fuel to the carburetor and engine as higher engine output is required, e.g., during periods of automobile acceleration and when increased load is placed on the engine. More particularly, the control valve of my copending application is automatically adjusted from fully open to partially closed position in response to changes in engine load conditions reflected by changes in vacuum pressure in the intake manifold of the engine. The control valve comprises a rotary valve having a valve plug with generally rectangular cross-sectional fuel flow passage therethrough. The valve is rotatably adjusted between fully open and only partially closed positions by a diaphragm motor connected to the valve stem which communicates by vacuum line to an intake manifold fitting on the engine.

Although the automatically adjusted valve construction of my copending application works well to provide improved fuel economy by varying fuel flow based on engine demand, I have found that its use with a broad range of internal combustion engines having different fuel supply requirements can be improved. In particular, I have found that in engine systems requiring precise metering of small amounts of fuel to the carburetor at idle and low load conditions of operation, when vacuum level is highest in the engine intake manifold, manual adjustment of the degree of maximum closure of the valve must be quite precise to prevent occasional tendency for slight fuel pressure build-up on the downstream side of the valve at the carburetor inlet at idle condition. In such situations, slightly more fuel may be supplied to the carburetor at idle condition than is actually required for optimum fuel economy.

BRIEF DESCRIPTION OF THE INVENTION AND OBJECTS

To prevent such tendencies, my present invention is directed to an improved fluid flow control valve arrangement incorporating, in combination in the fuel supply line to the carburetor, a flow control valve of the type described in my aforesaid application for supplying controlled amounts of additional fuel to the carburetor on demand at times of increased load on the engine, and a pressure regulator valve arranged in parallel therewith to supply fuel to the carburetor of the engine to ensure a desired minimum pressure of fuel at the carburetor inlet at idle and low load conditions of the engine. By means of this modification, I have found that the valve arrangement may be employed more universely in fuel supply systems for internal combustion engines without the necessity of such precise adjustment or fine tuning of the flow control valve.

It is therefore a primary object of the present invention to provide an improved fuel economizer system with fuel flow control valve means to ensure a predetermined minimum fuel pressure and supply to the carburetor of an internal combustion engine during low load and idle conditions, while providing for increased automatically metered fuel supply to the carburetor on demand during increased load conditions on the engine.

It is another object to provide a flow control valve arrangement particularly adapted for internal combustion engines which may be employed to automatically regulate flow of fuel to the carburetor of engine systems having different fuel supply and demand requirements.

BRIEF DESCRIPTION OF THE DRAWINGS

The invention will be better understood, and other objects thereof will become more apparent, from the following detailed description of a preferred embodiment of the invention, as illustrated in the accompanying drawings, in which:

FIGS. 3*a* and 3*b* are right side elevation views of the valve plug of the flow control valve of FIG. 2, FIG. 3*b* showing the valve rotated approximately 45° from its position in FIG. 3*a.

DETAILED DESCRIPTION OF PREFERRED EMBODIMENTS

Figure 1:
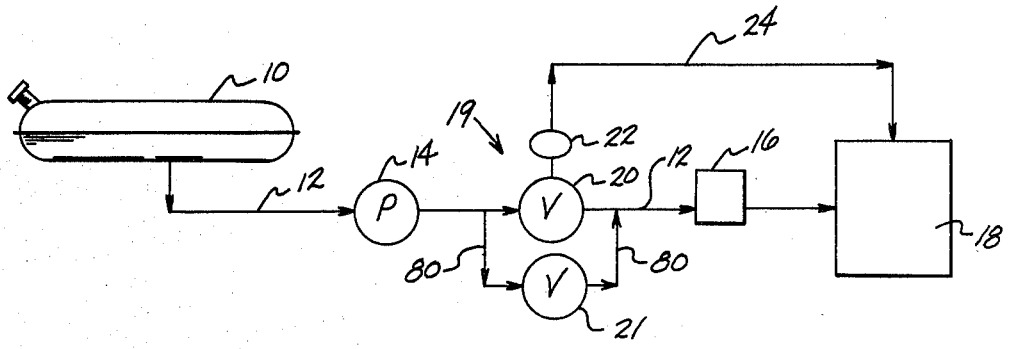
FIG. 1 is a diagrammatic drawing of a fuel supply system for an internal combustion engine with a valve arrangement of the present invention.

Referring more particularly to the drawings, FIG. 1 shows diagrammatically a fuel supply system for an automobile internal combustion engine which includes a fuel tank 10, a main fuel supply line 12, and a fuel pump 14 located in the supply line to provide fuel under pressure to the inlet of a carburetor 16 of an internal combustion engine 18. The fuel pump 14 is of conventional construction and operates in conventional manner to supply fuel to the fuel bowl, or reservoir, of the carburetor under a predetermined constant pressure sufficient to supply enough fuel to the engine for maximum fuel consuming conditions, i.e., under heaviest load conditions which the engine can be expected to incur. As a typical example, in a 400 cubic inch, 300 horsepower Chevrolet engine with a four barrel carburetor, the fuel pump is designed to provide 7 to 8½ pounds per square inch constant fuel pressure to the carburetor.

As seen in FIG. 1, located in fuel supply line 12 between fuel pump 14 and carburetor 16 is the valve arrangement 19 of the present invention which includes an automatically adjusted fuel flow control valve 20 and a self-operated pressure regulator valve 21 arranged in parallel with flow control valve 20. To automatically control the amount of fuel supplied to the inlet of the carburetor under certain load demand requirements of the engine, valve 20 is operatively connected by a diaphragm motor 22 and vacuum line 24 to a vacuum fitting on the intake manifold of engine 18, as will be explained in more detail hereinafter.

Figure 2:
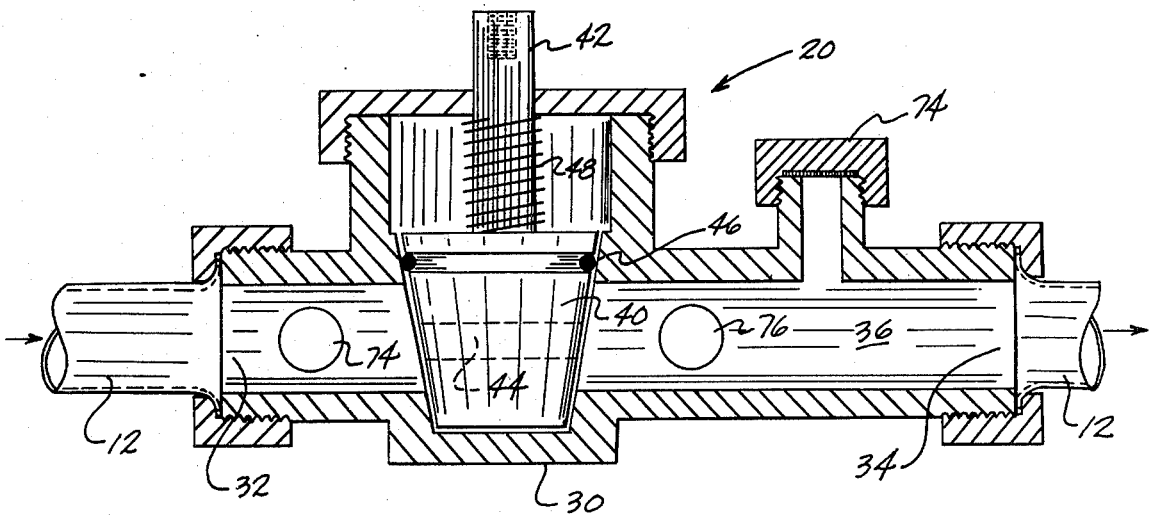
FIG. 2 is an enlarged cross-sectional view of the automatically adjusted first flow control valve portion of the valve arrangement illustrated diagrammatically in FIG. 1.
Figure 3A:
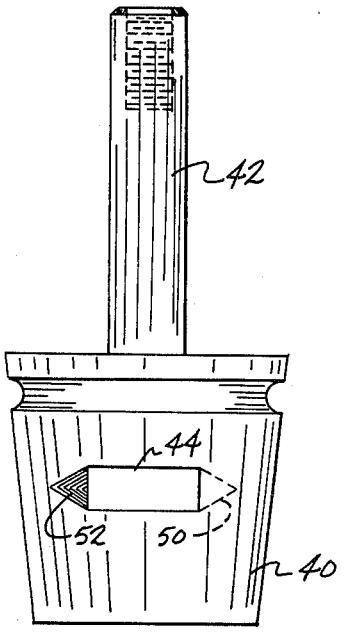

Referring to FIG. 2, the automatic flow control valve 20, in the embodiment shown, comprises a main valve body, or housing, 30 having a main fuel inlet 32, main fuel outlet 34, and a main fuel passageway 36 extending therebetween. Disposed in main passageway 36 is a rotatable, generally frusto-conical valve plug 40 having a valve stem 42. As seen in FIGS. 2 and 3*a*, valve plug 40 has a generally rectangular cross-sectional passageway 44 therethrough. As illustrated in FIG. 2, fuel inlet 32 of the valve housing is connected to the portion of fuel line 12 leading from the fuel pump, and the fuel outlet 34 is connected to the portion of fuel line 12 leading to the carburetor. Valve plug 40 has a peripheral groove with flexible O-ring 46 to seal the valve against fuel loss, and the plug is urged downwardly against the housing valve seat by a spring 48 surrounding the valve stem in the upper portion of the valve housing.

Figure 3B:
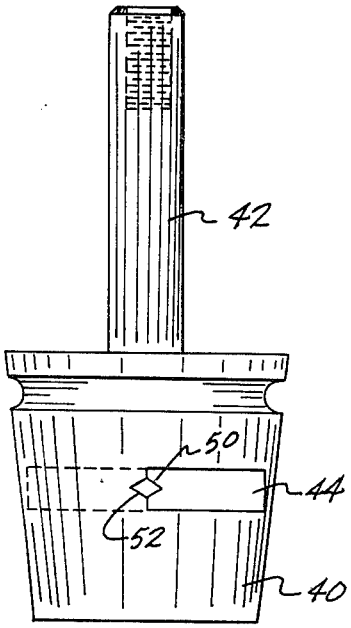

Passageway 44 through valve plug 40 is of the same internal cross-sectional area as the internal cross-sectional area of the main fuel line 12 to permit unrestricted flow of fuel from the fuel pump to the carburetor when valve plug 40 is in fully open position, as shown in FIG. 3*a*. Opposite sides of the opposite ends of the valve plug passageway 44 are further provided with tapered or V-shaped notches 50, 52. Thus, by rotating the valve stem and valve plug only approximately ¼ of a turn in the valve housing, the valve can be effectively utilized to accurately and precisely meter the flow of fuel through the valve from a full open position (FIG. 3*a*), to a full closed position. By tapering the opposite sides of the passageway in a V-shaped configuration, more accurate metering of small amounts of fuel to the carburetor can be accomplished, as illustrated by the almost closed position of the valve in FIG. 3*b*.

The automatic positioning of the valve plug 40 in response to vacuum changes in the engine intake manifold may best be described by reference to FIG. 4 which is a plan view of the valve arrangement of FIG. 1. As shown in partial section, diaphragm motor 22 is supportably attached to valve 20 by suitable means, such as a metal bracket 60 and fastening elements. Diaphragm motor 22 is of conventional construction and comprises a housing 61 containing a flexible diaphragm element 62 defining a compartment 64 in the housing. Movement of diaphragm element 62 in response to pressure changes in compartment 64 moves a lever arm 66 attached to the diaphragm, and a spring 68 urges the diaphragm and lever arm in an outward direction from the compartment. The spring's resistance to inward movement of the lever arm 66 and diaphragm 62 may be varied by an adjusting screw 70 engaging the end of spring 68. Compartment 64 is connected by means of vacuum line 24 to a vacuum fitting on the inlet manifold of the engine 18 (FIG. 1).

To operate the flow control valve 20, outer end of diaphragm lever arm 66 is pivotally connected to a second lever arm 72 attached by fastening means to the upper end of valve stem 42. Thus, the valve plug 40 is incrementally positionable from fully open to fully closed position under influence of pressure changes in diaphragm compartment 64 and the resistive force of spring 68. When there is little or no vacuum in the engine intake manifold, as when the engine is under heavy load conditions, and correspondingly little vacuum on diaphragm compartment 64, diaphragm element 62 is urged by spring 68 outwardly of the compartment 64 in the diaphragm motor, and lever arms 64, 72 rotate the valve plug to a fully open position. As vacuum increases on the diaphragm compartment 64 in response to increase in vacuum in the engine intake manifold, as when load decreases on the engine, the diaphragm element 62 moves against the force of spring 68 to rotate the valve plug toward a closed position. The point at which increasing vacuum in the intake manifold will fully close the valve 20 and, correspondingly, will initially open the valve to supply fuel to the carburetor during acceleration, may be adjustably set by spring adjustment screw 70.

Figure 4:
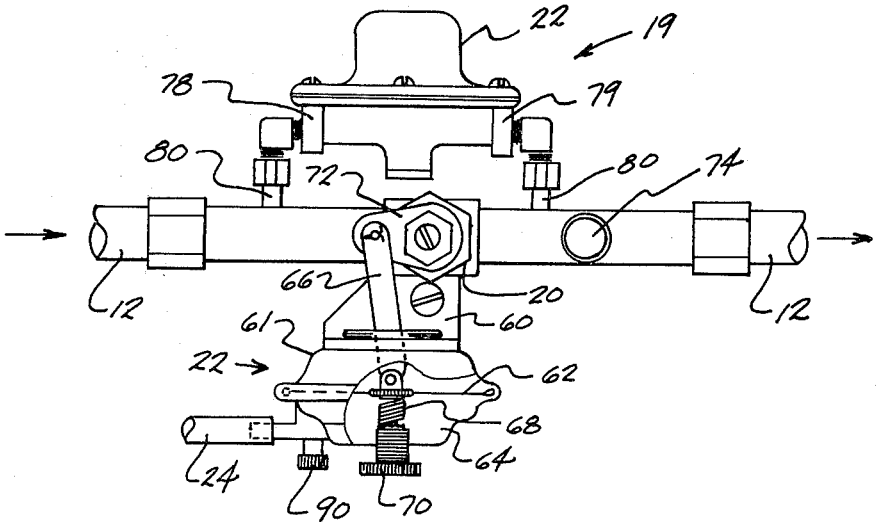
* and FIG. 4 is a schematic plan view of the valve arrangement of FIG. 1 showing, partially in section, the flow control and pressure regulator valves of FIG. 1, together with related control mechanisms therefor.
Figure 5:
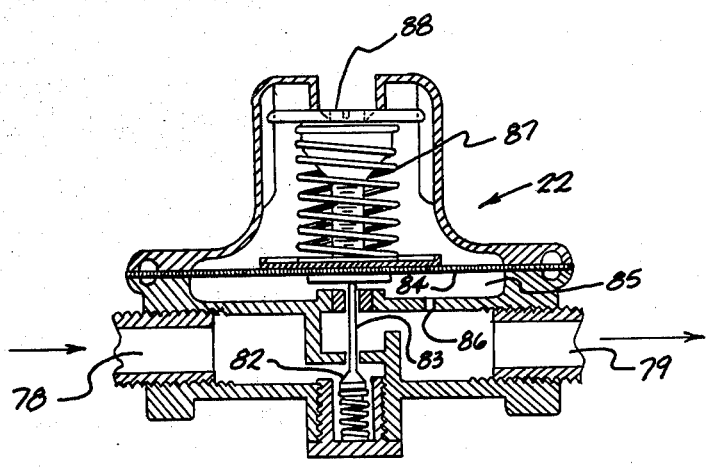
FIG. 5 is an enlarged horizontal cross sectional view of the pressure regulator valve portion of the valve arrangement as seen in top plan view in FIG. 4.

As seen in FIGS. 1, 4, and 5, located in the fuel supply line 12 in parallel with the flow control valve 20 is pressure regulator valve 21. The fuel inlet 78 and outlet 79 of regulator valve 21 respectively communicate by suitable conduits 80 with the main fuel line 12 on the upstream and downstream sides of fuel flow through valve 20. Note openings 74, 76 to the regulator valve 21 in valve 20 of FIG. 2. Regulator valve 21 includes a movable needle valve 82 connected by its valve stem 83 to a fuel pressure regulated diaphragm 84. The diaphragm encloses a compartment 85 which communicates by an opening 86 with the fuel flow passageway on the downstream side of needle valve 82. The resistance of the diaphragm 84 to displacement in compartment 85 by fuel pressure on the downstream side of the valve element 82 is provided by a spring 87, the force of which may be adjusted by means of an adjusting screw 88. Thus, the needle valve 82 may be set to open and close at a desired fuel pressure on the downstream side of the regulator valve, and thereby establish a desired minimum fuel pressure and fuel flow to the carburetor during idle and low load operation of the engine when the control valve 20 does not supply sufficient fuel to maintain the fuel pressure desired at the carburetor inlet.

The operation of the fuel economizer system of the present invention may be described as follows. For most automobile passenger car engines, a minimum fuel pressure of approximately one pound per square inch is generally sufficient to ensure proper fuel supply to the carburetor at idle condition of the engine. The pressure regulator valve 21 may be preset to one pound before installation of the valve assembly in the fuel line of the automobile. However, a test port 74 (FIGS. 2 and 4) is provided on the downstream side of the valves 20, 21 and the adjusting screw 70 of regulator valve 21 may be further adjusted to the minimum pressure and fuel supply requirements of the particular internal combustion engine on which the valve arrangement is installed. For adjustment on the automobile, with the engine at idle, a fuel pressure gauge is attached to the test port fitting 74 on the downstream side of valves 20 and 21. The flow control valve plug 40 is moved to a fully closed position by the diaphragm motor adjusting screw 70, while the adjusting screw 86 of pressure regulator valve is adjusted to provide a desired minimum fuel pressure reading on the pressure gauge which still provides sufficient fuel to the carburetor and engine to maintain proper idle conditions.

For most standard automobile engines, the intake manifold vacuum pressure at idle is around 18 to 24 inches of mercury. It has been found that a minimum of one pound fuel pressure at the carburetor inlet is generally sufficient to provide fuel under increasing load conditions on the engine until the intake vacuum pressure reaches about 12.5 to 13 inches of mercury. Therefore, the flow control valve 20 may also be preset before installation of the valve assembly to cause the valve to initially open and to close at a vacuum pressure of around 12 to 13 inches on the diaphragm motor 22. However, the flow control valve also may be adjusted after installation on the automobile by use of a vacuum test gauge inserted in the vacuum line 24 at a convenient point between the diaphragm 62 and the engine intake manifold, such as at a test port fitting 90 (FIG. 4) on the diaphragm housing 61. In such case, with the pressure regulator valve set at the desired minimum fuel pressure for adequate idle of the engine, the engine is gradually accelerated while placed under a load condition, such as in gear with brakes on. As the engine first indicates a need for increased fuel supply, the diaphragm spring screw 70 is adjusted to cause initial opening of the metering valve plug at or just before this point. This provides additional fuel supply to the engine proportional to further decrease in vacuum in the intake manifold. During operation of the engine, the valve plug 40 thus automatically adjusts in response to changes in vacuum pressure in the intake manifold of the engine above a desired load condition to provide optimum fuel supply to the carburetor under heavier load conditions, while the pressure regulator valve ensures the desired minimum fuel pressure and fuel flow to the carburetor and engine under lower load and idle conditions when the fuel flow through valve 20 is insufficient for this purpose.

Although the valve arrangement shown in the drawings has the fuel supply line 12 attached to the main passageway of the flow control valve 20, the fuel line 12 could be attached to the inlet and outlet of the pressure regulator valve 22, with the flow control valve 20 connected in parallel therewith by conduits, if desired. The flow control valve for supplying additional fuel to the carburetor in response to vacuum changes in the intake manifold may take other forms or constructions suitable for accurate automatic metering of precise amounts of fuel on demand from the engine in accordance with the present invention.

That which is claimed is:

1. In a fuel supply system for an internal combustion engine including a fuel supply tank, a fuel supply line connecting the tank to the fuel inlet of a carburetor of the engine, and a fuel pump in the supply line between the tank and carburetor for delivering fuel to the inlet of the carburetor; the improvement therein comprising:

fuel metering valve means located in the fuel line between the fuel supply pump and the inlet to the carburetor and incrementally adjustable between a closed and fully open position, and means operatively associated with said metering valve means for incrementally and automatically adjusting the metering valve means in response to variations in the engine load conditions during operating periods, including acceleration and deceleration of the engine, from a closed position at a predetermined low load condition on the engine while correspondingly increasing the fuel flow therethrough to the carburetor in response to increasing load conditions on the engine above said predetermined low load condition, and a self-operated pressure regulator valve located in the fuel supply line in parallel with said metering valve means between the fuel supply pump and the inlet to the carburetor for ensuring at least a predetermined minimum fuel pressure and fuel flow to said carburetor independent of operating conditions of the engine.

2. A fuel supply system as defined in claim 1 wherein said means for automatically adjusting the metering valve means comprises diaphragm motor means operatively connected to the metering valve means and to the intake manifold of the engine to incrementally adjust said valve means from fully opened to fully closed flow positions in response to variations in pressure in the intake manifold.

3. In a fuel supply system for an internal combustion engine including a fuel supply tank, a fuel supply line connecting the tank to the fuel inlet of a carburetor of the engine, and a fuel pump in the supply line for delivering fuel from the tank to the carburetor inlet; the improvement therewith comprising:

first and second valve means located in parallel in the supply line between the pump and carburetor inlet for controlling the flow of fuel from the pump to the carburetor inlet;

said first valve means including means for automatically delivering varying amounts of fuel to the carburetor inlet proportionally in response to changes in engine load conditions reflected by vacuum changes therein during periods including acceleration and deceleration of the engine; and said second valve means including means operative irrespective of load conditions for automatically maintaining a predetermined minimum fuel pressure and fuel flow to the carburetor inlet when said first valve means does not provide sufficient fuel flow to the carburetor inlet to maintain such minimum fuel pressure at the carburetor inlet.

4. Apparatus as defined in claim 3 wherein said first valve means automatic delivering means includes diaphragm motor means operatively connected to the intake manifold of the engine to vary the amount of fuel delivered to the carburetor inlet through the first valve means proportionally in response to vacuum changes in the intake manifold.

5. Apparatus as defined in claim 4 wherein said first valve means includes a valve member, said second valve means includes self-operated pressure regulator valve means for delivering fuel to the carburetor inlet at a preselected constant minimum fuel pressure when said first valve member is in a position which does not provide said minimum fuel pressure.

6. Apparatus as defined in claim 4 wherein said first valve means includes a valve element incrementally positionable between a closed and an open position to variably control the amount of fuel flow through said first valve means, and said diaphragm motor means is operatively connected thereto to move and variably position the member between closed position at a predetermined high vacuum level in the intake manifold and said open position in response to changes in vacuum level below said high vacuum level.

7. Apparatus as defined in claim 6 wherein said diaphragm motor means includes means for adjusting said closed position of said valve member to a desired vacuum level in the intake manifold.

8. Apparatus as defined in claim 6 wherein said valve element has a fuel flow passageway therethrough which has a cross-sectional area at least equal to the internal cross-sectional area of said fuel supply line such that unrestricted flow of fuel from the fuel pump to the carburetor inlet is obtained when the valve element is in fully open position in said first valve means.

* * * * *